US010301702B2

(12) United States Patent
Tanaka et al.

(10) Patent No.: US 10,301,702 B2
(45) Date of Patent: May 28, 2019

(54) STEEL SHEET FOR CANS AND MANUFACTURING METHOD THEREOF

(71) Applicants: JFE STEEL CORPORATION, Tokyo (JP); THYSSENKRUPP RASSELSTEIN GMBH, Andernach (DE); Thomas Fechner, Neuwied (DE)

(72) Inventors: Takumi Tanaka, Tokyo (JP); Yusuke Nakagawa, Tokyo (JP); Masaki Tada, Tokyo (JP); Katsumi Kojima, Tokyo (JP); Hiroki Nakamaru, Tokyo (JP); Kathleen Stein-Fechner, Andernach (DE); Burkhard Kaup, Andernach (DE)

(73) Assignees: JFE STEEL CORPORATION, Tokyo (JP); THYSSENKRUPP RASSELSTEIN GMBH, Andernach (DE)

( * ) Notice: Subject to any disclaimer, the term of this patent is extended or adjusted under 35 U.S.C. 154(b) by 261 days.

(21) Appl. No.: 15/313,729

(22) PCT Filed: May 11, 2015

(86) PCT No.: PCT/JP2015/063460
§ 371 (c)(1),
(2) Date: Nov. 23, 2016

(87) PCT Pub. No.: WO2015/082360
PCT Pub. Date: Dec. 3, 2015

(65) Prior Publication Data

US 2017/0198369 A1 Jul. 13, 2017

(30) Foreign Application Priority Data

May 30, 2014 (JP) ..... 2014-112883

(51) Int. Cl.
*C22C 38/04* (2006.01)
*C22C 38/06* (2006.01)
(Continued)

(52) U.S. Cl.
CPC ..... *C21D 9/46* (2013.01); *B22D 11/001* (2013.01); *C21D 8/0226* (2013.01);
(Continued)

(58) Field of Classification Search
None
See application file for complete search history.

(56) References Cited

U.S. PATENT DOCUMENTS

2014/0034195 A1 2/2014 Suto et al.

FOREIGN PATENT DOCUMENTS

CA 2769447 A1 2/2011
CN 101983246 A 3/2011
(Continued)

OTHER PUBLICATIONS

Aug. 11, 2015 International Search Report issued in International Patent Application No. PCT/JP2015/063460.
(Continued)

*Primary Examiner* — Deborah Yee
(74) *Attorney, Agent, or Firm* — Oliff PLC

(57) ABSTRACT

A can steel plate includes: equal or less than 0.0030% by mass of C; equal or less than 0.02% by mass of Si; 0.05-0.60% by mass of Mn; equal or less than 0.020% by mass of P; equal or less than 0.020% by mass of S; 0.010% to 0.100% by mass of Al; 0.0010-0.0050% by mass of N; 0.001-0.050% by mass of Nb; and balance Fe and impurities. Intensity of (111) [1-21] orientation (where −2 represents 2 with bar in Miller indices) and intensity of (111)[1-10] orientation (where −1 represents 1 with bar in Miller indices) satisfy the following equation (1), and in a rolling
(Continued)

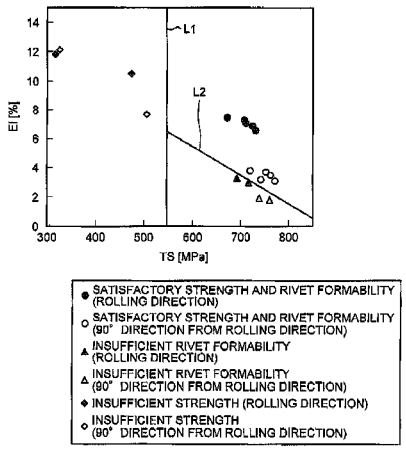

direction and 90° direction from the rolling direction in a horizontal plane, tensile strength TS (MPa) and fracture elongation El (%) satisfy relations of the following equations (2) and (3). (Intensity of (111) [1-21] orientation)/(Intensity of (111) [1-10] orientation)>0.9 . . . (1), TS>550 . . . (2), El>−0.02×TS+17.5 . . . (3).

8 Claims, 1 Drawing Sheet

(51) Int. Cl.

| | |
|---|---|
| ***C22C 38/12*** | (2006.01) |
| ***C22C 38/14*** | (2006.01) |
| ***C21D 9/46*** | (2006.01) |
| ***C21D 9/48*** | (2006.01) |
| ***C21D 8/02*** | (2006.01) |
| ***C21D 8/04*** | (2006.01) |
| ***C22C 38/00*** | (2006.01) |
| ***B22D 11/00*** | (2006.01) |
| ***C22C 38/02*** | (2006.01) |
| ***C23G 1/02*** | (2006.01) |

(52) U.S. Cl.

CPC ..... *C21D 8/0236* (2013.01); *C21D 8/0263* (2013.01); *C21D 8/0463* (2013.01); *C21D 9/48* (2013.01); *C22C 38/00* (2013.01); *C22C 38/001* (2013.01); *C22C 38/002* (2013.01); *C22C 38/004* (2013.01); *C22C 38/02* (2013.01); *C22C 38/04* (2013.01); *C22C 38/06* (2013.01); *C22C 38/12* (2013.01); *C22C 38/14* (2013.01); *C23G 1/02* (2013.01); *C21D 8/0426* (2013.01); *C21D 8/0436* (2013.01)

(56) References Cited

FOREIGN PATENT DOCUMENTS

| | | | |
|---|---|---|---|
| CN | 103597110 | A | 2/2014 |
| EP | 2275581 | A1 | 1/2011 |
| JP | H06-81038 | A | 3/1994 |
| JP | H06-248338 | A | 9/1994 |
| JP | H06-248339 | A | 9/1994 |
| JP | H08-41549 | A | 2/1996 |
| JP | H08-269568 | A | 10/1996 |
| JP | H11-209845 | A | 8/1999 |
| JP | 2001-107186 | A | 4/2001 |
| JP | 2001-107187 | A | 4/2001 |
| JP | 2007-291514 | A | 11/2007 |
| JP | 2008-202113 | A | 9/2008 |
| JP | 2010-150571 | A | 7/2010 |
| JP | 2012-107315 | A | 6/2012 |
| JP | 2013-133496 | A | 7/2013 |
| KR | 10-2010-0122941 | A | 11/2010 |
| WO | 2012/144213 | A1 | 10/2012 |

OTHER PUBLICATIONS

Aug. 11, 2015 Written Opinion issued in International Patent Application No. PCT/JP2015/063460.

L.G. Schulz. "A Direct Method of Determining Preferred Orientation of a Flat Reflection Sample Using a Geiger Counter X-Ray Spectrometer". Journal of Applied Physics, vol. 20, Nov. 1949, pp. 1030-1033.

M. Dahms et al. "The Iterative Series-Expansion Method for Quantitative Texture Analysis. I. General Outline". Journal of Applied Crystallography, vol. 22, 1989, pp. 439-447.

H.J. Bunge. "Texture Analysis in Materials Science". Mathematical Methods, Butterworths, London, 1982, pp. 4-8.

Oct. 6, 2016 Office Action issued in Japanese Patent Application No. 2015-555492.

Jan. 22, 2016 Office Action issued in Taiwanese Patent Application No. 104117424.

Aug. 1, 2017 Office Action issued in Chinese Patent Application No. 201580028367.7.

Nov. 10, 2017 Search Report issued in European Patent Application No. 15799689.3.

Jan. 9, 2018 Office Action issued in Korean Patent Application No. 2016-7032535.

Dec. 20, 2017 Office Action issued in Canadian Patent Application No. 2,950,068.

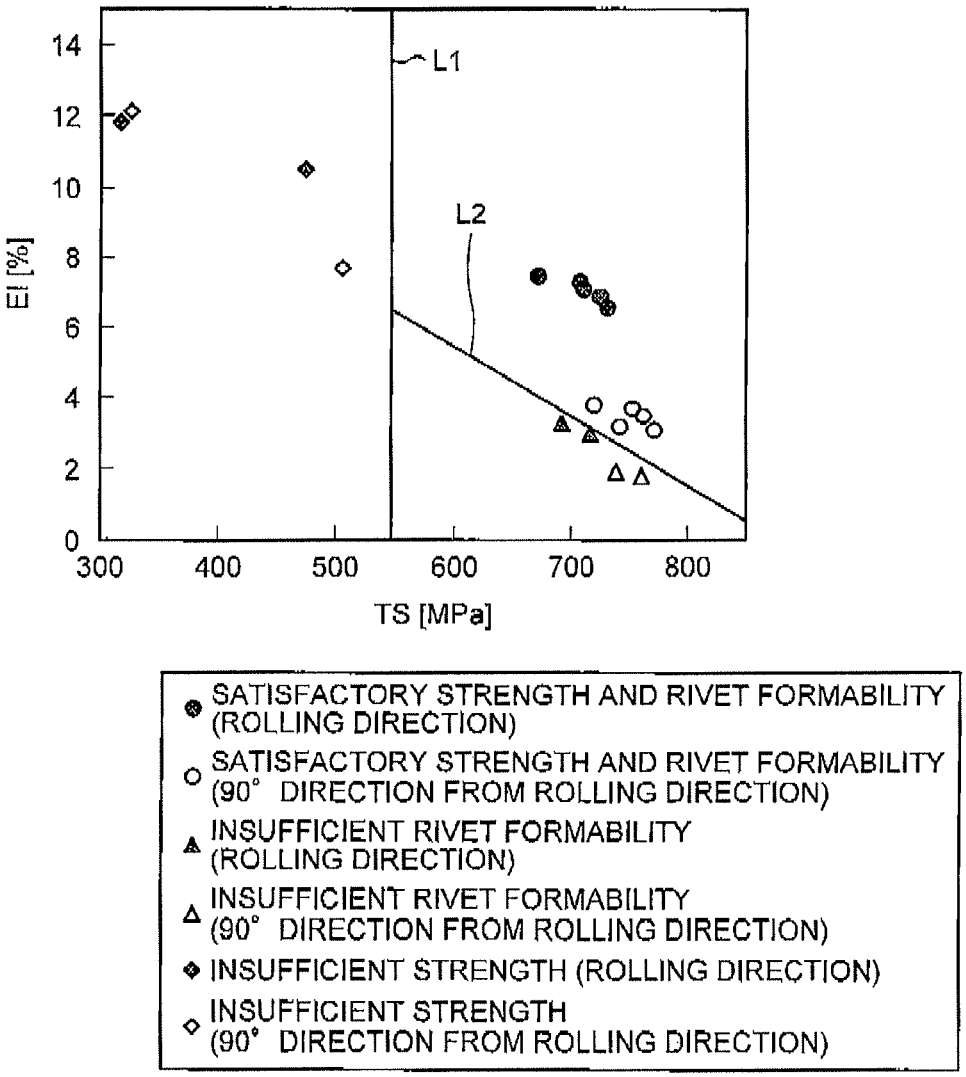
14
12
10
8
6
4
2
0
El [%]
300
400
500
600
700
800
TS [MPa]
L1
L2
SATISFACTORY STRENGTH AND RIVET FORMABILITY (ROLLING DIRECTION)
SATISFACTORY STRENGTH AND RIVET FORMABILITY (90° DIRECTION FROM ROLLING DIRECTION)
INSUFFICIENT RIVET FORMABILITY (ROLLING DIRECTION)
INSUFFICIENT RIVET FORMABILITY (90° DIRECTION FROM ROLLING DIRECTION)
INSUFFICIENT STRENGTH (ROLLING DIRECTION)
INSUFFICIENT STRENGTH (90° DIRECTION FROM ROLLING DIRECTION)

STEEL SHEET FOR CANS AND MANUFACTURING METHOD THEREOF

FIELD

The present invention relates to a can steel plate used in a container material of beverages and foods and a method of manufacturing the same.

BACKGROUND

In recent years, the cost for manufacturing a steel can has been reduced to expand the demand for the Steel cans as a can steel plate. For reducing the cost for manufacturing a steel can, the cost of a steel plate to be used may be reduced. Thus, as well as a two-piece can in which a drawing process is performed in a can manufacturing process, in a body or a cover of a three-piece can in which simple cylindrical forming is a main body of the can manufacturing process, thinning of the steel plate to be used has progressed. However, when the steel plate is simply thinned, a can body strength is decreased. Accordingly, for such a usage, a thin-walled can steel plate with the higher strength has been desired. In addition, an easy open end (hereinafter, referred to as EOE) used as a lid of a beverage can, a food can, or the like is provided with a tab by a rivet process, and thus formability causing no breaking by rivet forming is required.

Currently, the thin-walled can steel plate with the high strength is manufactured by a double reduce method (hereinafter, referred to as a DR method) of performing a secondary cold rolling process after an annealing process. The manufacturing process according to the DR method includes a hot rolling process, a cold rolling process, an annealing process, and a secondary cold rolling process. In the manufacturing process according to the DR method, the number of processes is more than that of the conventional manufacturing process in which the last process is the annealing process by one, and thus the cost is increased. The cost reduction is being desired even for such a can steel plate, and thus it is necessary to omit the secondary cold rolling process causing the high cost.

Accordingly, a method of manufacturing a high-strength can steel plate in processes upto an annealing process by adding a strengthening element or changing a manufacturing condition is proposed. Specifically, Patent Literature 1 discloses a method of manufacturing a steel plate with small in-plane anisotropy by performing a recrystallization annealing process after a cold rolling process. The steel plate with the small in-plane anisotropy is suitable for a can in which a process along a specific direction cannot be performed and a drawing process is performed. However, in the steel plate in which the in-plane anisotropy is not substantially a problem, it is not necessary to perform the recrystallization annealing process after the cold rolling process.

Hitherto, an as-rolled plate in which a heat treatment is not performed after a cold rolling process or a steel plate in which ductility is recovered by a heat treatment at a temperature equal to or lower than a recrystallization completion temperature has been studied. Since the strengthening element is not added to such a steel plate, an influence on corrosion resistance is small, and it can be used as a beverage can or a food can at ease. Accordingly, when it is not required that the in-plane anisotropy is small, a method of manufacturing a high-strength steel plate by performing a recovery annealing process at a temperature equal to or lower than the recrystallization completion temperature is effective. Therein, the following technique is proposed.

Patent Literature 2 discloses a technique of obtaining a steel plate with a high yield strength by performing a finish rolling process at a temperature equal to or lower than an $Ar_3$ transformation formability at a hot rolling process, performing a cold rolling process at a rolling rate equal to or lower than 85%, and then performing a heat treatment for 10 minutes within a temperature range of 200 to 500° C.

Patent Literature 3 discloses a technique of making Rockwell hardness (HR30T) by performing an annealing process within a temperature range equal to or higher than 400° C. and equal to or lower than a recrystallization temperature after performing a cold rolling process.

Patent Literature 4 disclose a technique of obtaining a steel plate with a high elastic modulus by performing a hot rolling process at a temperature equal to or lower than an $Ar_3$ transformation formability at a rolling reduction equal to or higher than 50% using the steel with the same composition as that of the steel disclosed in Patent Literature 3, performing a cold rolling process at a rolling reduction equal to or higher than 50%, and then an annealing process within a temperature range equal to or higher than 400° C. and equal to or lower than a recrystallization temperature. In Patent Literature 4, it is determined that a recrystallization temperature is a temperature at which a recrystallization rate is an organization of 10%.

Patent Literature 5 discloses a technique of obtaining a steel plate with a high yield strength by performing a finish rolling process in which a total rolling reduction at a temperature equal to or lower than an $Ar_3$ transformation formability is equal to or higher than 40% at the time of a hot rolling process, performing a cold rolling process at a rolling reduction equal to or higher than 50%, and then performing an annealing process for a short time within a temperature range of 350 to 650° C.

Patent Literature 6 discloses a method of manufacturing a steel plate having full elongation equal to or higher than 5% with a tensile strength of magnitude of 550 to 600 MPa by performing an annealing process within a temperature range of (a recrystallization start temperature −200) to (a recrystallization start temperature −20)° C.

Patent Literature 7 discloses a method of manufacturing a steel plate with a tensile strength of 600 to 850 MPa by performing a hot rolling process equal to or higher than 5% and less than 50% of a total rolling reduction amount in a finish rolling process at a temperature lower than an $Ar_3$ transformation formability, and performing an annealing process within a temperature range from 400° C. to (recrystallization temperature −20°) C.

Patent Literature 8 discloses a method of manufacturing a steel plate in which a value of (intensity of {112}<110>orientation)/(intensity of {111}<112>orientation) is equal to or more than 1.0, a tensile strength in a direction of 90° from a rolling direction in a horizontal plane is 550 to 800 MPa, and Young's modulus is equal to or higher than 230 GPa, by performing an annealing process within a temperature range of 520 to 700°.

CITATION LIST

Patent Literature

Patent Literature 1: Japanese Patent Application Laid-open No. 2001-107186

Patent Literature 2: Japanese Patent Application Laid-open No. 8-269568

Patent Literature 3: Japanese Patent Application Laid-open No. 6-248338

Patent Literature 4: Japanese Patent Application Laid-open No. 6-248339

Patent Literature 5: Japanese Patent Application Laid-open No. 8-41549

Patent Literature 6: Japanese Patent Application Laid-open No. 2008-202113

Patent Literature 7: Japanese Patent Application Laid-open No. 2010-150571

Patent Literature 8: Japanese Patent Application Laid-open No. 2012-107315

Non-Patent Literatures

Non-Patent Literature 1: L. G. Schulz: J. Appl. Phys., 20 (1949), 1030-1033

Non-Patent Literature 2: M. Dahms and H. J. Bunge: J. Appl. Cryst., 22 (1989), 439-447

Non-Patent Literature 3: H. J. Bunge: Texture Analysis in Materials Science, Butterworths, London, (1982)

SUMMARY

Technical Problem

However, in a method such as a DR method of work-hardening after an annealing process, although the strength of a steel plate increases, an elongation thereof significantly deteriorates, so that a balance between the strength and the elongation deteriorates. For this reason, in a can manufacturing process, fracture caused by shortage of elongation may occur. Further, in a method such as solid solution strengthening and precipitation strengthening based on a strengthening element, a lot of energy is consumed for thinning at the time of a cold rolling process, and thus production efficiency is drastically decreased.

In the methods disclosed in Patent Literatures 2, 4, 5, and 7, it is necessary to perform a finish rolling process at a temperature equal to or lower than the $Ar_3$ transformation formability at the time of a hot rolling process. When the finish rolling process is performed at a temperature equal to or lower than the $Ar_3$ transformation formability, a ferrite particle diameter of a hot rolling material becomes large, and thus this method is effective as a method of decreasing the strength of the steel plate after the hot rolling process. However, at a plate width edge portion, a cooling speed is higher than that of a plate width center portion, and thus a temperature of the plate width edge portion at the time of the finish rolling process tends to be lowered. For this reason, formability introduced at the time of the finish rolling process is not released by recrystallization or recovery, and the strength of the plate width edge portion tends to rise. As a result, the difference in strength between the plate width center portion and the plate width edge portion becomes large, and it is difficult to obtain a hot-rolled steel plate uniform in a width direction.

In the method disclosed in Patent Literature 3 or 4, an annealing process is performed within a temperature range equal to or higher than 400° C. and equal to or lower than a recrystallization temperature, and the strength of the obtained steel plate is about 65 to 70 by the Rockwell hardness. However, in order to obtain a steel plate at a strength level directed by the invention, it is necessary to further lower an annealing temperature. For this reason, it is necessary to provide an annealing cycle having an annealing temperature range lower than a general annealing temperature, and productivity of an annealing line is decreased by the change in temperature.

In the method, disclosed in Patent Literature 6, a steel plate with a plate thickness equal to or less than 0.18 mm is a target, and thus it is difficult to apply the method to the manufacturing of the steel plate over 0.18 mm. In addition, the method disclosed in Patent Literature 6 is a method of manufacturing a can steel plate used as a DRD can or a welded can, and thus it is difficult to obtain the formability necessary for the rivet forming of the EOE.

In the method disclosed in Patent Literature 8, an annealing process is performed within a temperature range of 520 to 700° C. However, when the upper limit value of the temperature range of the annealing process is too high, a desired tensile strength may not be obtained by occurrence of recrystallization. In addition, in the method disclosed in Patent Literature 8, a ratio of an intensity (111) [1-21] orientation (where −2 represents 2 with a bar in Miller indices) and an intensity of (111) [1-10] orientation (where −1 represents 1 with a bar in Miller indices) is too small, and thus it is difficult to obtain a sufficient, fracture elongation.

The invention has been made to solve the above-described problem, and an object of the invention is to provide a can steel plate and a method of manufacturing the same, capable of maintaining high pressure capacity even when the can steel plate is thinned to be used.

Solution to Problem

A can steel plate according to the present invention includes: equal to or less than 0.0030% by mass of C; equal to or less than 0.02% by mass of Si; 0.05% to 0.60% by mass of Mn; equal to or less than 0.020% by mass of P; equal to or less than 0.020% by mass of S; 0.010% to 0.100% by mass of Al; 0.0010% to 0.0050% by mass of N; 0.001% to 0.050% by mass of Nb; and balance re and inevitable impurities, wherein an intensity of (111)[1-21] orientation (where −2 represents 2 with a bar in Miller indices) and an intensity of (111)[1-10] orientation (where −1 represents 1 with a bar in Miller indices) satisfy the following equation (1), and in a rolling direction and a 90° direction from the rolling direction in a horizontal plane, a tensile strength TS (MPa) and a fracture elongation El (%) satisfy relations of the following equation (2) and equation (3).

$$(\text{Intensity of } (111)[1\text{-}21]\text{orientation})/(\text{Intensity of } (111)[1\text{-}10]\text{orientation}) \geq 0.9 \quad (1)$$

$$TS \geq 550 \quad (2)$$

$$El > -0.02 \times TS + 17.5 \quad (3)$$

The can steel plate according to the present invention is characterized in that, in the above invention, it further includes 0.0005% to 0.0020% by mass of B.

The can steel plate according to the present invention is characterized in that, in the above invention, it further includes 0.001% to 0.050% by mass of Ti.

A method of manufacturing a can steel plate including: forming a steel having a chemical component of the can steel plate according to the present invention into a slab by continuous casting; subjecting the slab to hot rough rolling; performing a finish rolling process within a temperature range of 850 to 960° C.; coiling up the plate in a temperature range of 500 to 600° C. and pickling the plate by acid; performing a cold rolling process at a rolling rate equal to or lower than 92%; performing an annealing process within a temperature range of 600 to 650° C.; and performing a temper rolling process.

Advantageous Effects of Invention

According to the invention, it is possible to provide a can steel plate and a method of manufacturing the same, capable of maintaining high pressure capacity even when the can steel plate is thinned to be used.

BRIEF DESCRIPTION OF DRAWINGS

FIG. 1 is a diagram illustrating a relation among fracture elongation, tensile strength, and rivet formability in a rolling direction and a 90° direction from a rolling direction in a horizontal plane.

DESCRIPTION OF EMBODIMENTS

Hereinafter, the invention will be described in detail.

Component Composition of can Steel Plate

First, a component composition of a can steel plate according to the invention will be described. All units of content are mass.

Content of C

The can steel plate according to the invention achieves a high strength by formability introduced by a cold rolling process, and it is necessary to avoid an increase of the strength caused by alloy elements as much as possible. When the content of C exceeds 0.0030%, it is difficult to sufficiently obtain local ductility necessary for shaping, and breaking or wrinkle may occur at the time of shaping. Accordingly, the content of C is equal to or less than 0.0030%.

Content of Si

Si is an element increasing the strength of steel by solid solution strengthening, but addition of Si over 0.02% is not preferable by the same reason as that of C. In addition, when a large amount of Si is added, a plating property is impaired and corrosion resistance is significantly decreased. Accordingly, the content of Si is equal to or less than 0.02%.

Content of Mn

When the content of Mn is less than 0.05%, it is difficult to avoid hot brittleness even when the content of S is decreased, and a problem such as surface cracking occurs at the time of continuous casting. Accordingly, the lower limit value of the content of Mn is 0.05%. Meanwhile, in a ladle analysis value of Standards of American Society for Testing and Materials (ASTM), it is prescribed that the upper limit value of the content of Mn in a tin plate original sheet used in a general food container is 0.60%. When the content of Mn exceeds the upper limit value, Mn is thickened onto the surface and Mn oxides are thereby formed, which causes adverse effects on corrosion resistance. For this reason, the upper limit of the content of Mn is equal to or less than 0.60%.

Content of P

When the content of P exceeds 0.020%, hardening or decrease of corrosion resistance of the steel occurs. Accordingly, the upper limit value of the content of P is 0.020%.

Content of S

S couples with Mn in steel to form MnS, a large amount of which are precipitated to decrease hot ductility of the steel. An influence of a portion where the content of S exceeds 0.020% is significant. Accordingly, the upper limit value of the content of S is 0.020%.

Content of Al

Al is an element added as a deoxidizing agent. In addition, Al forms AlN with N to have an effect of decreasing a solid solution N of the steel. However, when the content of Al is less than 0.010%, it is difficult to sufficiently obtain the deoxidizing effect and the effect of decreasing the solid solution N. Meanwhile, when the content of Al exceeds 0.10%, the effects are saturated, and a problem that a manufacturing cost is increased or an occurrence rate of a surface defect is increased. Accordingly, the content of Al is within the range equal to or more than 0.010% and equal to or less than 0.100%.

Content of N

N couples with Al or Nb to form nitrides or carbonitrides, and decreases hot ductility. For this reason, the content of N is preferably small. However, it is difficult that the content of N is stably less than 0.0010%, and a manufacturing cost is also increased. Accordingly, the lower limit value of the content of N is 0.0010%. In addition, N is one of solid solution strengthening elements. When the content of N exceeds 0.0050%, the steel is hardened, elongation is significantly decreased, and formability deteriorates. Accordingly, the upper limit value of the content of N is 0.0050%.

Content of Nb

Nb is an element with a high carbide generative capacity, and a recrystallization temperature is increased by a grain boundary pinning effect based on the generated carbide. Accordingly, by changing the content of Nb, the recrystallization temperature of the steel is controlled, and it is possible to perform an annealing process at a desired temperature. As a result, by matching the annealing temperature with the other steel plate, it is possible to match a chance of charging to the annealing line, and thus it is very efficient from the aspect of productivity. However, when the content of Nb exceeds 0.050%, a recrystallization temperature becomes too high, and a cost of the annealing process is increased. In addition, since the strength becomes higher than the strength of a target by precipitation strengthening of carbide, the content of Nb is equal to or less than 0.050%. In the invention, an element of raising the strength of the steel plate is not positively added, but it is necessary to add Nb from the view point of adjusting the annealing temperature. When the content of Nb is equal to or less than 0.050%, it is possible to adjust the strength using the precipitation strengthening of Nb. In addition, the recrystallization at the time of welding is suppressed by the addition of Nb, and thus it is possible to prevent a welding strength from decreasing. Meanwhile, when the content of Nb is less than 0.001%, the effect described above is not exhibited, and thus the lower limit value of the content of Nb is 0.001%.

Content of B

B is an element of raising the recrystallization temperature. Accordingly, B may be added for the same purpose as that of Nb. However, when B is excessively added, the recrystallization in an austenite area is prevented at the time of the hot rolling process, and thus rolling load has to be large. For this reason, the upper limit value of the content of B is 0.0020%. In addition, when the content of B is equal to or less than 0.0005%, it is difficult to raise the recrystallization temperature, and thus the lower limit value of the content of B is 0.0005%.

Content of Ti

Ti is also en element of forming the carbonitride, and may be added to obtain an effect of fixing C and N in the steel as a precipitate. When the effect is sufficiently exhibited, the content equal to or more than 0.001% is necessary. Meanwhile, when the content of Ti is too large, the function of decreasing solid solutions C and N is saturated, and a production cost is also increased since Ti is expensive. For this reason, it is necessary to suppress the content of Ti to be equal to or less than 0.050%. Accordingly, when Ti is added, the content of Ti is within the range equal to or more than 0.001% and equal to or less than 0.050%.

The remaining includes Fe and inevitable impurities.

Texture of can Steel Plate

Next, a texture of the can steel plate according to the invention will be described.

As a rolling texture of the steel plate, a fiber in which [1-10] orientation (where −1 represents 1 with a bar in Miller indices) is parallel in a rolling direction and γ fiber in which a (111) plane is parallel to a rolling face are mainly developed. Between them, in the α fiber, formability energy accumulated by rolling is relatively low, and hardness is also low. On the other hand, in the γ fiber, formability energy accumulated by rolling is high, and hardness is also high. There is such a rolling texture even in a recovery annealing material. However, the inventors of the invention found that deviation of a ratio of orientation has an influence on elongation in crystal grains constituting the γ fiber thereof.

That is, the elongation becomes larger as the orientation of the crystal grains constituting the γ fiber becomes more random, and the elongation becomes smaller as the deviation to a specific orientation becomes larger. When the orientation of γ fiber grains is biased, there may be many grains having [1-10] orientation (where −1 represents 1 with a bar in Miller indices), and there may be little grains having [1-21] orientation (where −2 represents 2 with a bar in Miller indices). Accordingly, a ratio of an intensity of (111)[1-21] orientation (where −2 represents 2 with a bar in Miller indices) and an intensity of (111)[1-10] orientation (where −1 represents 1 with a bar in Miller indices) is calculated to assess deviation of a ratio of orientation of crystal grains constituting the γ fiber. When the ratio is less than 0.9, the deviation of the orientation of the γ fiber is too large, and it is difficult to obtain necessary elongation.

Accordingly, the intensity of (111)[1-21] orientation (where −2 represents 2 with a bar in Miller indices) and the intensity of (111)[1-10] orientation (where −1 represents 1 with a bar in miller indices) satisfy a relation of the following equation (4). In addition, it is particularly preferable that the relation is satisfied in the range of a depth of ¼ of a plate thickness from the surface. In addition, the intensity of the rolling texture may be measured by an X-ray diffractometer. Specifically, positive pole figures of (110) plane, (200) plane, (211) plane, and (222) plane are measured by a reflection method, and a crystal orientation distribution function (ODF) is calculated by spherical harmonics expansion. It is possible to calculate the intensity of each orientation from the ODF acquired as described above.

$$(\text{Intensity of } (111)[1\text{-}21]\text{orientation})/(\text{Intensity of } (111)[1\text{-}10]\text{orientation}) \geq 0.9 \quad (4)$$

Mechanical Property of can Steel Plate

Next, a mechanical property of the can steel plate according to the invention will be described.

According to the invention, by performing a recovery annealing process after a cold rolling process, it is possible to obtain a steel plate excellent in a balance between strength and ductility. FIG. 1 illustrates a relation among fracture elongation El (%), tensile strength TS (MPa), and rivet formability in a rolling direction and a 90° direction from a rolling direction in a horizontal plane. When the tensile strength TS is less than 550 MPa represented by the line L1 in the FIGURE, it is difficult to be used in a thin-walled can steel plate requiring a high strength. In addition, when the fracture elongation El is equal to or less than (−0.02×TS+17.5) represented by the line L2 in the FIGURE, the ductility is too small with respect to the strength, and breaking or thickness-direction necking occurs in rivet forming of EOE. Accordingly, in the rolling direction and the 90° direction from the rolling direction in the horizontal plane, the tensile strength TS is equal to or more than 550, and the fracture elongation El is more than (−0.02×TS+17.3). In addition, according to the manufacturing method to be described below, by appropriately adjusting the annealing temperature, it is possible to obtain the steel plate with the desired strength and fracture elongation.

Method of Manufacturing can Steel Plate

Next, an example of a method of manufacturing the can steel plate according to the invention will be described.

When the can steel plate according to the invention is manufactured, the molten steel is adjusted in the chemical component by the known method using the converter furnace or the like, and is made into a slab by a continuous casting method. Subsequently, the slab is subjected to hot rough rolling. The method of the rough rolling is not limited, but a heating temperature of the slab is preferably equal to or higher than 1250° C.

Finish Temperature of Hot Rolling Process

The finish temperature of the hot rolling process is equal to or higher than 850° C. from the view point of grain refinement or uniformity of precipitate distribution. Meanwhile, even when the finish temperature is too high, the γ grain growth after rolling occurs further violently, and the α grains after transformation is coarsened by the coarse γ grains according thereto. Specifically, the finish temperature is within the temperature range of 850 to 960° C. When the finish temperature is lower than 850° C., the rolling is performed at a temperature equal to or lower than the $Ar_3$ transformation formability, and the α grains are coarsened.

Coiling Temperature of Hot Rolling Process

In the temperature range in which the coiling temperature of the hot rolling process is lower than 500° C., the intensity of (111)[1-21] orientation (where −2 represents 2 with a bar in Miller indices) and the intensity of (111) [1-10] orientation (where −1 represents 1 with a bar Miller indices) at a plate thickness ¼ portion from the surface of the recovery annealing process do not satisfy the relation represented in the equation (4) described above. Meanwhile, when the coiling temperature is higher than 600° C., the proceeding of recovery is prevented, and it is difficult to obtain the desired fracture elongation. Accordingly, the coiling temperature of the hot rolling process is within the temperature range of 500 to 600° C., and more preferably within the temperature range of 500 to 550° C. A subsequently performed acid pickling process may remove a surface layer scale, and it is not necessary to particularly limit a condition.

Rolling Reduction of Cold Rolling Process

The can steel plate according to the invention obtains desired characteristics by performing the recovery annealing process on the steel plate after the cold rolling process. Accordingly, the cold rolling process is essential. In order to manufacture an ultra-thin material, the rolling reduction of the cold rolling process is preferably high. However, when the rolling reduction of the cold rolling process exceeds 92%, the load of a mill is excessive, and thus the rolling reduction of the cold rolling process is equal to or less than 92%.

Annealing Temperature

The annealing (heat treatment) process is performed within the range of 600 to 650° C. The purpose of the annealing process in the invention is to decrease the strength down to the target strength by performing the recovery annealing process from the state where the strength is raised by formability introduced by the cold rolling process. When the annealing temperature is lower than 600° C., the formability is not sufficiently released and the strength becomes higher than the target strength. For this reason, 600° C. is the lower limit of the annealing temperature. Meanwhile, when the annealing temperature is too high, the recrystallization is started and softened, and it is difficult to obtain the tensile strength equal to or more than 550 MPa. For this reason, 650° C. is the upper limit of the annealing temperature. As the annealing method, it is preferable to use a continuous annealing method from the view point of uniformity of a material and high productivity. The soaking time at the time of the annealing process is preferably within the range equal to or more than 10 seconds and equal to or less than 60 seconds from the view point of productivity. The subsequently performed temper rolling is performed to adjust surface roughness or shape of the steel plate, but it is not necessary to particularly limit the reduction condition.

EXAMPLE

Steel containing the component composition illustrated in Table 1 with the balance Fe and inevitable impurities was melted, and a steel slab was obtained by continuous casting. Subsequently, a thin steel plate was obtained under a manufacturing condition illustrated in Table 2. Specifically, the obtained steel slab was reheated at 1250° C., and then the hot rolling process was performed in which the finish temperature was within the range of 870 to 900° C. and the coiling temperature was within the range of 490 to 610° C. Then, after the acid pickling process, the cold rolling process was performed at the rolling reduction of 90.0 to 91.5%, and the thin steel plate with 0.16 to 0.22 mm was manufactured. The obtained thin steel plate was subjected to the recovery annealing process in a continuous annealing furnace at the annealing temperature of 610 to 660° C. for the annealing time of 30 sec, and the temper rolling process was performed such that an elongation rate was equal to or lower than 1.5%.

TABLE 1

(Mass %)

| | C | Si | Mn | P | S | Al | H | Nb | Ti | B |
|---|---|---|---|---|---|---|---|---|---|---|
| Level 1 | 0.0025 | 0.012 | 0.42 | 0.014 | 0.019 | 0.041 | 0.0044 | 0.025 | — | — |
| Level 2 | 0.0019 | 0.017 | 0.51 | 0.020 | 0.017 | 0.027 | 0.0012 | 0.031 | — | — |
| Level 3 | 0.0028 | 0.010 | 0.39 | 0.013 | 0.012 | 0.086 | 0.0032 | 0.042 | — | 0.0011 |
| Level 4 | 0.0022 | 0.015 | 0.24 | 0.018 | 0.018 | 0.014 | 0.0046 | 0.009 | 0.038 | — |
| Level 5 | 0.0029 | 0.014 | 0.18 | 0.015 | 0.008 | 0.053 | 0.0025 | 0.014 | — | — |
| Level 6 | 0.0026 | 0.016 | 0.27 | 0.017 | 0.016 | 0.046 | 0.0033 | 0.029 | — | — |
| Level 7 | 0.0027 | 0.013 | 0.38 | 0.014 | 0.015 | 0.033 | 0.0035 | 0.03 | — | — |
| Level 8 | 0.0027 | 0.016 | 0.45 | 0.015 | 0.015 | 0.038 | 0.0035 | — | — | — |
| Level 9 | 0.0293 | 0.013 | 0.28 | 0.012 | 0.011 | 0.045 | 0.0039 | 0.030 | — | — |
| level 10 | 0.0024 | 0.018 | 0.50 | 0.014 | 0.013 | 0.042 | 0.0033 | 0.024 | — | — |
| Level 11 | 0.0026 | 0.012 | 0.33 | 0.016 | 0.018 | 0.051 | 0.0029 | 0.039 | — | — |
| Level 12 | 0.0023 | 0.011 | 0.40 | 0.012 | 0.013 | 0.029 | 0.0028 | 0.033 | — | — |

TABLE 2

| | Hot Rolling | | | | | Final | Temper | |
|---|---|---|---|---|---|---|---|---|
| | Slab Reheating Temperature (° C.) | Finish Rolling Temperature (° C.) | Coiling Temperature (° C.) | Cold Rolling Reduction (%) | Annealing Temperature (° C.) | Finish Plate Thickness (mm) | rolling (Secondary Rolling) Rate (%) | Remark |
| Level 1 | 1250 | 890 | 510 | 90.0 | 640 | 0.22 | 1.0 | Invention Example |
| Level 2 | 1250 | 880 | 530 | 90.0 | 650 | 0.18 | 1.0 | Invention Example |
| Level 3 | 1250 | 900 | 520 | 91.5 | 620 | 0.20 | 1.0 | Invention Example |
| Level 4 | 1250 | 885 | 545 | 90.0 | 630 | 0.21 | 1.0 | Invention Example |
| Level 5 | 1250 | 890 | 500 | 90.0 | 630 | 0.16 | 1.0 | Invention Example |
| Level 6 | 1250 | 890 | 560 | 90.0 | 630 | 0.19 | 1.0 | Invention Example |
| Level 7 | 1250 | 890 | 585 | 90.0 | 630 | 0.18 | 1.0 | Invention Example |
| Level 8 | 1250 | 880 | 520 | 90.0 | 610 | 0.22 | 1.0 | Comparative Example |
| Level 9 | 1250 | 890 | 540 | 91.5 | 630 | 0.20 | 1.5 | Comparative Example |
| Level 10 | 1250 | 870 | 490 | 90.5 | 640 | 0.21 | 1.0 | Comparative Example |
| Level 11 | 1250 | 900 | 570 | 91.0 | 660 | 0.20 | 1.0 | Comparative Example |
| Level 12 | 1250 | 900 | 610 | 90.0 | 630 | 0.21 | 1.0 | Comparative Example |

With respect to the steel plates obtained as described above, a tensile test was performed. The tensile test was performed by the method described in ISO 6892-1 using a tensile test piece of a type 1 size prescribed in ISO 6892-1 Appendix B, and the tensile strength and the fracture elongation (percentage total elongation at maximum fracture) were assessed.

The rolling texture was measured at a plate thickness ¼ position by performing a thickness reduction process and chemical grinding (oxalic acid etching) for the purpose of formability removal. An X-ray diffractometer was used in the measurement, and pole figures of (110) plane, (200) plane, (211) plane, and (222) plane were created by a reflection method disclosed in Non-Patent Literature 1. ODF was calculated by a series expansion method disclosed in Non-Patent Literature 2 from such pole figures, the intensity was acquired in which $\Phi=55°$, $\varphi_1=30°$, and $\varphi_2=45°$ of Euler space (Bunge manner) disclosed in Non-Patent Literature 3 were (111)[1-21] orientation (where −2 represents 2 with a bar in Miller indices), and $\Phi=55°$, $\varphi_1=0°$, and $\varphi_2=45°$ were (111)[1-10] orientation (where −1 represents 1 with a bar in Miller indices).

From Table 3, in the steel plates of the levels 1 to 7 that are the invention examples, in the rolling direction and the 90° direction from the rolling direction in the horizontal plane, the tensile strength TS 550, the fracture elongation El>−0.02×TS+17.5, and the value of (intensity of (111)[1-21] orientation)/(intensity of (111)[1-10] orientation) at the plate thickness ¼ portion from the surface was equal to or more than 0.9, and all of them represented satisfactory rivet formability. Meanwhile, in the steel plate of the level 8 that is the comparative example, the content of Nb was too small, the recrystallization temperature was low, the recrystallization occurred in the recovery annealing process, and the tensile strength was short. In the steel plate of the level 9 that is the comparative example, the content of C was too large, the ductility was damaged, and the breaking occurred in the rivet forming.

In the steel plate of the level 10 that is the comparative example, the coiling temperature after the hot rolling was too low, the value of (intensity of (111)[1-21] orientation)/(intensity of (111)[1-10] orientation) at the plate thickness ¼ portion from the surface after the recovery annealing process was less than 0.9, and the breaking occurred in the rivet forming. In the steel plate of the level 11 that is the comparative example, the annealing temperature in the recovery annealing process was too high, the recrystallization occurred, and the tensile strength was insufficient. In the steel plate of the level 12, since the coiling temperature after the hot rolling was too high, the proceeding of recovery was decreased, the fracture elongation was insufficient, and thus the breaking occurred in the rivet forming.

TABLE 3

| | Rolling Direction | | | 90° Direction from Rolling Direction | | | (111) [1$\bar{2}$1] | (111) [1$\bar{1}$0] | Rivet | | |
|---|---|---|---|---|---|---|---|---|---|---|---|
| | [TS] (MPa) | [El] (%) | −0.02 × [TS] + 17.5 | [TS] (MPa) | [El] (%) | − 0.02 × [TS] + 17.5 | X-ray intensity | X-ray intensity | (111) [1$\bar{2}$1]/(111) [110] | Form-ability | Remark |
| Level 1 | 708 | 7.3 | 3.3 | 742 | 3.2 | 2.7 | 7.0 | 6.9 | 1.01 | A | Invention Example |
| Level 2 | 672 | 7.5 | 4.1 | 720 | 3.8 | 3.1 | 6.8 | 6.5 | 1.05 | A | Invention Example |
| Level 3 | 725 | 6.9 | 3.0 | 763 | 3.5 | 2.2 | 7.2 | 7.2 | 1.00 | A | Invention Example |
| Level 4 | 731 | 6.6 | 2.9 | 772 | 3.1 | 2.1 | 7.4 | 7.2 | 1.03 | A | Invention Example |
| Level 5 | 711 | 7.1 | 3.3 | 754 | 3.7 | 2.4 | 6.9 | 6.9 | 1.00 | A | Invention Example |
| Level 6 | 681 | 5.1 | 3.9 | 728 | 3.2 | 2.9 | 7.3 | 7.5 | 1.00 | B | Invention Example |
| Level 7 | 696 | 4.2 | 3.6 | 740 | 3.0 | 2.7 | 7.1 | 7.5 | 0.90 | B | Invention Example |
| Level 8 | 317 | 11.8 | 11.2 | 326 | 12.1 | 11.0 | 7.8 | 7.6 | 1.03 | B | Comparative Example |
| Level 9 | 717 | 3.0 | 3.2 | 761 | 1.8 | 2.3 | 7.2 | 7.1 | 1.01 | C | Comparative Example |
| Level 10 | 693 | 3.3 | 3.6 | 739 | 1.9 | 2.7 | 5.8 | 7.0 | 0.83 | C | Comparative Example |
| Level 11 | 475 | 10.5 | 8.0 | 506 | 7.7 | 7.4 | 7.7 | 7.8 | 0.99 | B | Comparative Example |
| Level 12 | 681 | 3.6 | 3.9 | 715 | 2.8 | 3.2 | 7.0 | 6.8 | 1.00 | C | Comparative Example |

INDUSTRIAL APPLICABILITY

According to the present invention, it is possible to provide a can steel plate and a method of manufacturing the same, capable of maintaining high pressure capacity even when the can steel plate is thinned to be used.

The invention claimed is:

1. A can steel plate comprising:

equal to or less than 0.0030% by mass of C;

equal to or less than 0.02% by mass of Si;

0.05% to 0.60% by mass of Mn;

equal to or less than 0.020% by mass of P;

equal to or less than 0.020% by mass of S;

0. 010% to 0.100% by mass of Al;

0. 0010% to 0.0050% by mass of N;

0. 001% to 0.050% by mass of Nb; and balance Fe and inevitable impurities, wherein an intensity of (111) [1-21] orientation (where −2 represents 2 with a bar in Miller indices) and an intensity of (111)[1-10] orientation (where −1 represents 1 with a bar in Miller indices) satisfy the following equation (1), and in a rolling direction and a 90° direction from the rolling direction in a horizontal plane, a tensile strength TS (MPa) and a fracture elongation El (%) satisfy relations of the following equation (2) and equation (3):

$$(\text{Intensity of (111) [1-21] orientation})/(\text{Intensity of (111) [1-10] orientation}) \geq 1.0 \quad (1)$$

$$TS \geq 550 \quad (2)$$

$$El > -0.02 \times TS + 17.5 \quad (3).$$

2. The can steel plate according to claim 1, further comprising 0. 0005% to 0.0020% by mass of B.

3. The can steel plate according to claim 1, further comprising 0.001% to 0.050% by mass of Ti.

4. A method of manufacturing a can steel plate comprising:

forming a steel having a chemical component of a can steel plate into a slab by continuous casting;

subjecting the slab to hot rough rolling;

performing a finish rolling process within a temperature range of 850 to 960° C.;

coiling up the slab in a temperature range of 500 to lower than 550° C. and pickling the slab by acid;

performing a cold rolling process at a rolling rate equal to or lower than 92%;

performing an annealing process within a temperature range of 600 to 650° C.; and performing a temper rolling process, wherein the can steel plate comprising:

equal to or less than 0.0030% by mass of C;

equal to or less than 0.02% by mass of Si;

0. 05% to 0.60% by mass of Mn;

equal to or less than 0.020% by mass of P;

equal to or less than 0.020% by mass of S;

0. 010% to 0.100% by mass of Al;

0. 0010% to 0.0050% by mass of N;

0. 001% to 0.050% by mass of Nb; and balance Fe and inevitable impurities, wherein an intensity of (111) [1-21] orientation (where −2 represents 2with a bar in Miller indices) and an intensity of (111) [1-10] orientation (where −1 represents 1 with a bar in Miller indices) satisfy the following equation (1), and in a rolling direction and a 90° direction from the rolling direction in a horizontal plane, a tensile strength TS (MPa) and a fracture elongation El (%) satisfy relations of the following equation (2) and equation (3):

$$(\text{Intensity of (111) [1-21] orientation})/(\text{Intensity of (111) [1-10] orientation}) \geq 1.0 \quad (1)$$

$$TS \geq 550 \quad (2)$$

$$El > -0.02 \times TS + 17.5 \quad (3).$$

5. The can steel plate according to claim 2, further comprising 0.001% to 0.050% by mass of Ti.

6. The method of manufacturing a can steel plate according to claim 4, wherein the can steel plate further comprises 0.001% to 0.050% by mass of Ti.

7. The method of manufacturing a can steel plate according to claim 4, wherein the can steel plate further comprises 0.0005% to 0.0020% by mass of B.

8. The method of manufacturing a can steel plate according to claim 6, wherein the can steel plate further comprises 0.0005% to 0.0020% by mass of B.

* * * * *